US006330772B1

(12) United States Patent
Mitchell et al.

(10) Patent No.: US 6,330,772 B1
(45) Date of Patent: Dec. 18, 2001

(54) METHOD AND APPARATUS FOR ERECTING WALL PANELS

(75) Inventors: Everett Lee Mitchell, Evergreen; Jed D. Mitchell, Lakewood, both of CO (US)

(73) Assignee: Elward Systems Corporation, Lakewood, CO (US)

( * ) Notice: Subject to any disclaimer, the term of this patent is extended or adjusted under 35 U.S.C. 154(b) by 0 days.

(21) Appl. No.: 09/334,124

(22) Filed: Jun. 15, 1999

Related U.S. Application Data

(63) Continuation of application No. 08/989,748, filed on Dec. 12, 1997, now Pat. No. 5,916,100.

(51) Int. Cl.[7] ..... E04B 2/16

(52) U.S. Cl. ..... 52/235; 52/546; 52/547; 52/127.8; 52/204.72; 52/506.1

(58) Field of Search ..... 52/235, 474, 506.1, 52/543, 506.01, 544, 506.06, 546, 506.05, 547, 533, 127.8, 127.12, 127.2, 204.64, 204.65, 204.7, 204.72

(56) References Cited

U.S. PATENT DOCUMENTS

| | | | | |
|---|---|---|---|---|
| 754,888 | | 3/1904 | Pease . | |
| 2,304,423 | * | 12/1942 | Schiller | 52/204.72 |
| 2,414,628 | | 1/1947 | Battin . | |
| 3,053,353 | * | 9/1962 | Miller | 52/204.62 |
| 3,081,849 | * | 3/1963 | Hubbard | 52/204.6 |
| 3,210,808 | | 10/1965 | Creager . | |
| 3,212,225 | * | 10/1965 | Neal | 52/204.7 |
| 3,340,663 | * | 9/1967 | Collard | 52/204.6 |
| 3,429,090 | | 2/1969 | Metelnick | 52/481 |
| 3,436,885 | | 4/1969 | Rothermel | 52/207 |
| 3,566,561 | * | 3/1971 | Tozer | 52/204.62 |
| 3,608,264 | | 9/1971 | Jones et al. . | |
| 3,736,717 | | 6/1973 | Farley | 52/476 |
| 3,805,470 | * | 4/1974 | Brown | 52/397 |
| 3,973,368 | | 8/1976 | Moeller | 52/476 |
| 4,053,008 | | 10/1977 | Baslow | 160/327 |
| 4,057,947 | | 11/1977 | Oide | 52/496 |
| 4,070,806 | | 1/1978 | Hubbard | 52/95 |
| 4,123,883 | * | 11/1978 | Barber, Jr. et al. | 52/200 |
| 4,344,267 | | 8/1982 | Sukolics | 52/762 |
| 4,525,966 | * | 7/1985 | Litchfield et al. | 52/397 |
| 4,685,263 | | 8/1987 | Ting | 52/235 |
| 4,840,004 | | 6/1989 | Ting | 52/235 |
| 4,866,896 | | 9/1989 | Shreiner et al. | 52/235 |
| 5,095,676 | | 3/1992 | Mühle | 52/476 |
| 5,184,440 | | 2/1993 | Felix et al. | 52/235 |
| 5,444,945 | | 8/1995 | Goodwin | 52/65 |
| 5,735,089 | * | 4/1998 | Smith et al. | 52/202 |
| 5,797,229 | * | 8/1998 | Alvarez et al. | 52/204.62 |
| 5,809,729 | | 9/1998 | Mitchell | 52/474 |
| 5,916,100 | | 6/1999 | Mitchell et al. . | |
| 6,082,064 | | 7/2000 | Mitchell et al. . | |
| 6,105,333 | * | 8/2000 | Meesemaeeker et al. | 52/716.8 |

* cited by examiner

*Primary Examiner*—Carl D. Friedman
*Assistant Examiner*—Phi Dieu Tran A
(74) *Attorney, Agent, or Firm*—Sheridan Ross P.C.

(57) ABSTRACT

The wall panel system of the present invention includes a flexible sheet interlock to flexibly seal a joint defined by adjacent perimeter framing members and a capillary break to inhibit the entry of water into drainage or weep holes in gutters in the perimeter framing members.

30 Claims, 15 Drawing Sheets

FIG. 1
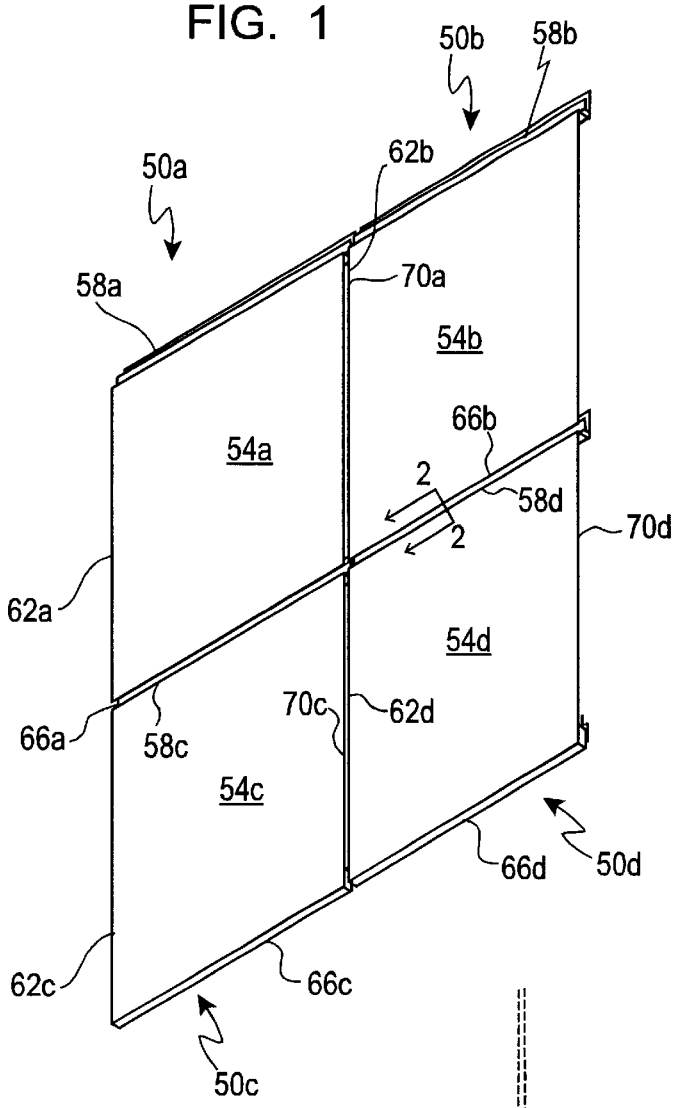
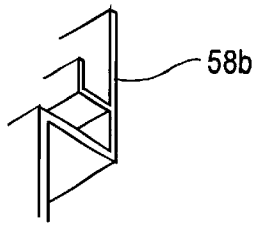
FIG. 1B
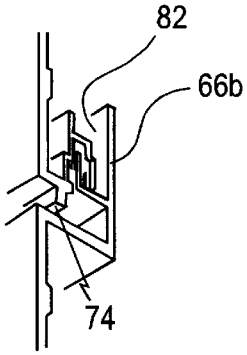
FIG. 1C
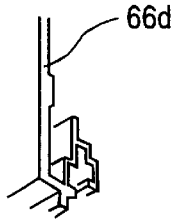
FIG. 1D
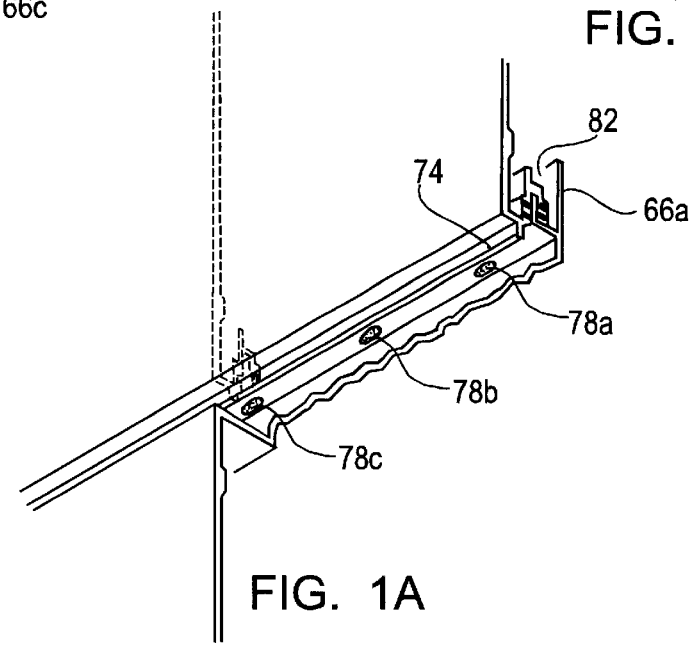
FIG. 1A FIG. 6A
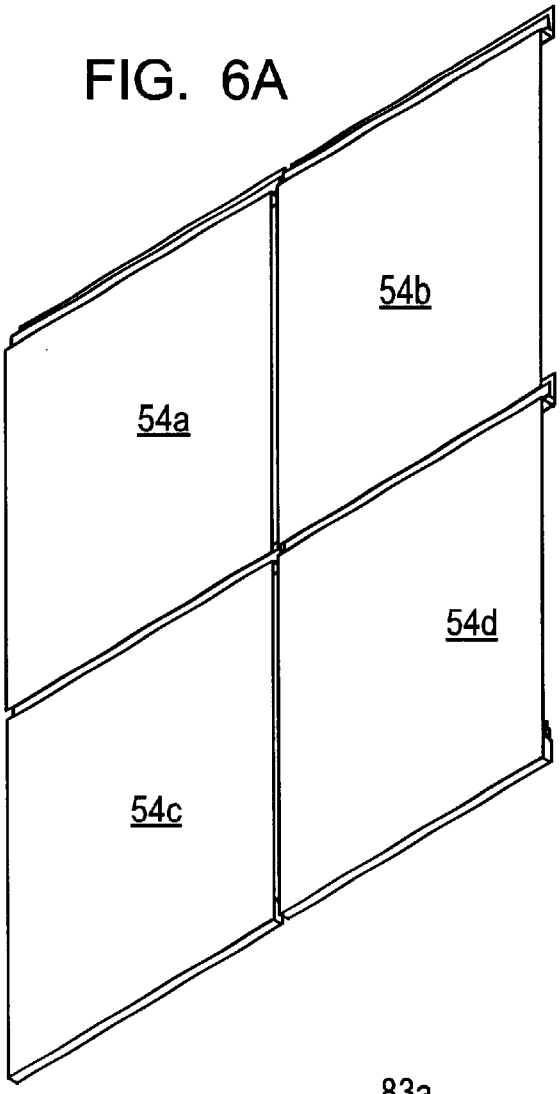
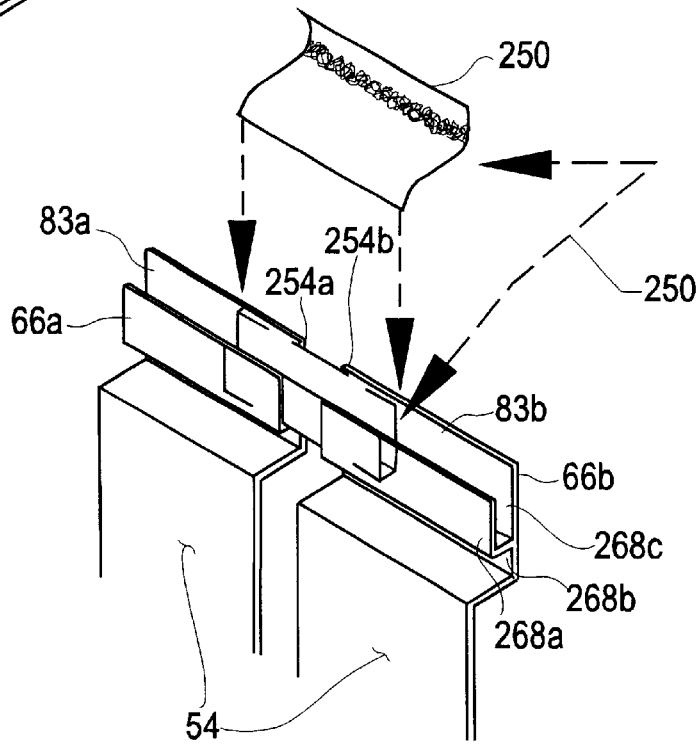
FIG. 6B

METHOD AND APPARATUS FOR ERECTING WALL PANELS

RELATED APPLICATIONS

This is a continuation application of U.S. patent application Ser. No. 08/989,748, filed Dec. 12, 1997, now U.S. Pat. No. 5,916,100 which is incorporated herein by reference.

FIELD OF THE INVENTION

The present invention is directed generally to apparatus and methods for erecting wall panels and specifically to perimeter framing members for attaching wall panels to structural members.

BACKGROUND OF THE INVENTION

The exterior walls of many commercial and industrial buildings are formed by mounting a number of wall panels and attached perimeter extrusions on a grid framework of structural members attached to the building. The resulting grid of wall panels are aesthetically attractive and protect the building structure from fluids in the terrestrial environment.

In designing a wall panel mounting system, there are a number of objectives. First, the joints between the wall panels should be substantially sealed from terrestrial fluids. Penetration of terrestrial fluids behind the wall panels can cause warpage and/or dislocation of the wall panels, which can culminate in wall panel failure. Second, any sealing material used in the joints between the wall panels should be nonskinning and non-hardening. The sealing material is located in a confined space in the joint. To maintain the integrity of the seal between the wall panels when the panels expand and contract in response to thermal fluctuations and other building movements (e.g., seismically induced movements), the sealing material must be able to move with the wall panels without failure of the seal. If the sealing material hardens or "sets up", the sealing material can break or shear, thereby destroying the weather seal. Third, the longevity of the sealing material should be at least as long as the useful life of the wall panels. Fourth, the sealing material should be capable of being pre-installed before erection of a wall panel beside a previously installed wall panel to provide for ease and simplicity of wall panel installation and low installation costs. Wall panel systems presently must be installed in a "stair step" fashion (i.e., a staggered or stepped method) because the sealing material must be installed only after both of the adjacent wall panels are mounted on the support members. Fifth, a drainage system or gutter should be employed to drain any fluids that are able to penetrate the seal in the joints. The gutter, which commonly is a "U"-shaped member in communication with a series of weep holes, must not overflow and thereby provide an uncontrolled entry for terrestrial fluids into the interior of the wall. During storms, winds can exert a positive pressure on the wall, thereby forcing terrestrial fluids to adhere to the surface of the wall (i.e., known as a capillary attraction). In other words, as the fluids follow the wall profile, the fluids can be drawn through the weep holes into gutter. The amount of terrestrial fluids drawn through the weep holes is directly proportional to the intensity of the storm pressure exerted on the wall exterior. If a sufficient amount of fluids enter the weep holes, the gutter can overflow, leaking fluids into the wall interior. Such leakage can cause severe damage or even panel failure.

SUMMARY OF THE INVENTION

These and other design considerations are addressed by the wall panel attachment system of the present invention. In a first aspect of the present invention, the wall panel attachment system includes an upper perimeter framing member attached to an upper wall panel and a lower perimeter framing member attached to a lower wall panel. The upper and lower perimeter framing members engage one another at perimeter edges of the upper and lower, typically vertically aligned, wall panels to define a recess relative to the upper and lower wall panels. At least one of the upper and lower perimeter framing members includes a plurality of drainage (or weep) holes for the drainage of terrestrial fluids located inside of the upper and lower perimeter framing members. At least one of the upper and lower perimeter framing members further includes a capillary break or blocking means (e.g., an elongated ridge running the length of the perimeter framing members) that (a) projects into the recess, (b) is positioned between the exterior of the upper and lower wall panels on the one hand and the plurality of drainage holes on the other, (c) is positioned on the same side of the recess as the plurality of drainage holes, and (d) is spaced from the plurality of drainage holes. The portion of the recess located interiorly of the capillary break is referred to as the circulating chamber. The capillary break inhibits terrestrial fluids, such as rainwater, from entering the plurality of drainage holes and substantially seals the joint between the upper and lower perimeter framing members from penetration by fluids.

While not wishing to be bound by any theory, the capillary break induces vortexing of any airstream containing droplets, thereby removing the droplets from the airstream, upstream of the weep holes. Vortexing is induced by a decrease in the cross-sectional area of airflow (causing an increase in airstream velocity) as the airstream flows towards and past the capillary break followed by a sudden increase in the cross-sectional area of flow downstream of the capillary break (causing a decrease in airstream velocity). Behind and adjacent to the capillary break, the sudden decrease in airstream velocity causes entrained droplets to deposit on the surface of the recess. To induce vortexing, the capillary break can have a concave or curved surface on its rear surface (adjacent to the circulating chamber). The rear surface of the capillary break is adjacent to the weep holes.

To inhibit entry of the droplets into the weep holes adjacent to the capillary break, the weep holes must be located at a sufficient distance from the capillary break and a sufficient distance above the free end of the capillary break to remove the weep holes from the vortex. Preferably, the capillary break and weep holes are both positioned on the same side of a horizontal line intersecting the free end of the capillary break. Typically, the distance between the rear surface of the capillary break and the adjacent drainage holes (which are typically aligned relative to a common axis) is at least about 0.25 inches. Commonly, the distance of the weep holes above the free end of the capillary break is at least about 125% of the distance from the free end of the capillary break to the opposing surface of the recess.

The drainage holes and capillary break can be located on the same perimeter framing member or on different perimeter framing members.

To form a seal between the perimeter framing members of adjacent, horizontally aligned wall panels, a second aspect of the present invention employs a flexible sheet interlock, that is substantially impervious to the passage of terrestrial fluids, to overlap both of the perimeter framing members to inhibit the passage of terrestrial fluids in the space between the perimeter framing members.

The flexible sheet interlock is preferably composed of a sealing non-skinning and non-hardening material that has a useful life at least equal to that of the wall panels. In this manner, the integrity of the seal between the wall panels is maintained over the useful life of the panels. The most preferred sealing material is silicone or urethane. The flexible sheet interlock, being non-skinning and nonhardening, can move freely, in response to thermally induced movement of the wall panels, without failure of the seal.

The flexible sheet interlock can be pre-installed before erection of an adjacent wall panel to provide for ease and simplicity of wall panel installation and low installation costs. The flexible sleet interlock can be installed on the wall panel and folded back on itself during installation of the adjacent wall panel. After the adjacent wall panel is installed, the interlock can simply be unfolded to cover the joint between the adjoining wall panels.

BRIEF DESCRIPTION OF THE DRAWINGS

FIG. 1 depicts a number of adjoining wall panels attached by a first embodiment of the wall panel mounting system according to a first aspect of the present invention;

FIG. 1A is an exploded view of interconnected upper and lower perimeter framing members attached to panels 54*a* and 54*b* of the first embodiment viewed from in front of the wall panels, with a portion of the upper perimeter framing member being cutaway to reveal the drainage holes and capillary break;

FIG. 1B is an exploded view of the lower perimeter framing member 58*b* of the first embodiment;

FIG. 1C is an exploded view of interconnected upper and lower perimeter framing members 66*b* and 58*d* of the first embodiment;

FIG. 1D is an exploded view of the upper perimeter framing member 66*d* of the first embodiment;

FIG. 6A depicts a number of adjoining wall panels sealed by a third embodiment of a wall panel mounting according to a second aspect of the present invention;

FIG. 6B is an exploded view of interconnected lower perimeter framing members of adjoining wall panels of the third embodiment viewed from in front of the wall panels, with the upper perimeter framing member being cutaway to reveal the flexible sheet interlock;

DETAILED DESCRIPTION

Figure 2:
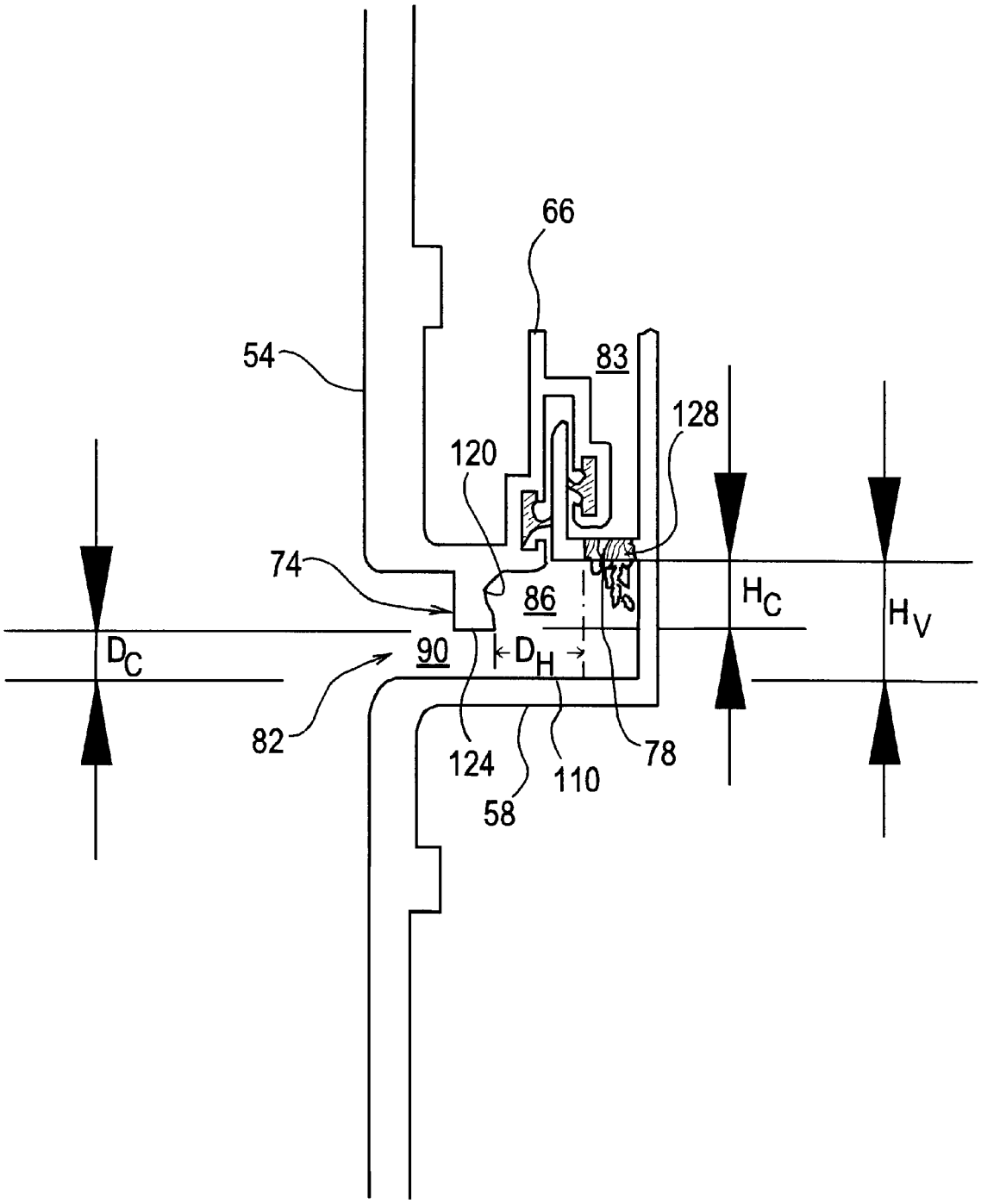
FIG. 2 is a cross-sectional view of the wall panel mounting system of the first embodiment taken along lines 2—2 of FIG. 1.

The first aspect of the present invention is directed to retarding the passage of terrestrial fluids through the joint between adjoining upper and lower wall panels. FIG. 1 depicts tour adjacent wall panel mounting assemblies 50*a*–*d* and the attached vertically oriented wall panels 54*a*–*d* according to the first aspect of the present invention. Each wall panel mounting assembly 50*a*–*d* includes a number of perimeter framing members 58*a*–*d*, 62*a*–*d*, 66*a*–*d* and 70*a*–*d* engaging each edge of the wall panels 54*a*–*d*. Perimeter framing member 50 engages perimeter framing member 66, and perimeter framing member 62 engages perimeter framing member 70. As can be seen from FIGS. 1B–1D, the upper perimeter framing members 66 are configured to interlock in a nested relationship with the lower perimeter framing members 58. Referring to FIG. 1A, at least one of the upper and lower perimeter framing members has a capillary break 74 and a plurality of drainage holes 78*a*–*c* in communication with a gutter 83 (defined by the perimeter framing member).

The wall panels can be composed of a variety of materials, including wood, plastics, metal, ceramics, masonry, and composites thereof. A preferred composite wall panel is metal- or plastic-faced with a wood, metal, or plastic core. A more preferred wall panel is a composite of metal and plastics sold under the trademark "ALUCOBOND".

Figure 3:
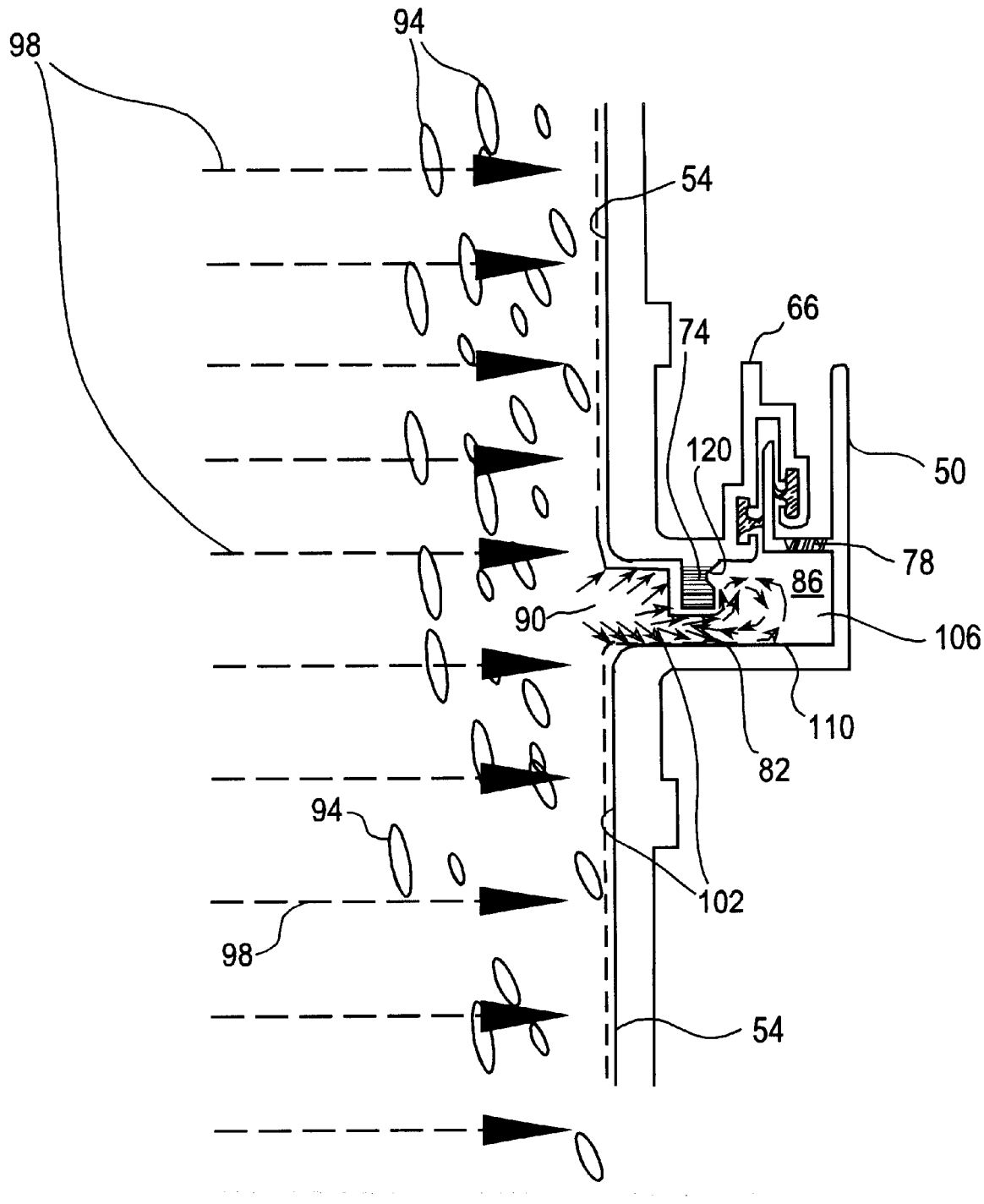
FIG. 3 is a sectional view of the wall panel mounting system of the first embodiment taken along lines 2—2 of FIG. 1 depicting the impact of the capillary break on airflow during a storm.

Referring to FIGS. 1A, 2 and 3, the upper and lower perimeter framing members 66 and 58 define a recess 82. The capillary break 74 extends downwardly from the upper perimeter framing member 66 to divide the recess 82 into a circulating chamber 86 and an inlet 90. The capillary break 74 is located nearer the wall panel 54 than the drainage holes 78 to block or impede the flow of droplets 94 entrained in the airstream 98 into the drainage holes 78.

FIG. 3 depicts the operation of the capillary break 74 and circulating chamber 86 during a storm. The airstream or wind 98 forces droplets of water 94 against the wall panels 54 A film 102 of water forms on the exterior surfaces of the wall. The wind pressure forces entrained droplets of water 94 and the film 102 into the inlet 90 between the wall panels 54. The capillary break 74, which runs continuously along the length of the perimeter framing member 66, decreases the cross-sectional area of air flow and therefore increases the velocity of the droplets 90. As the entrained droplets 90 enter the circulating chamber 86, the cross-sectional area of flow increases and therefore the velocity of the droplets 90 decreases forming a vortex 106. As a result, the droplets 90 have insufficient velocity to remain entrained in the air and the droplets collect in the film 102 on the lower surface 110 of the recess 82.

The degree of vortexing of the airstream depends, of course, on the increase in the cross-sectional area of flow as the airstream flows past the capillary break and into the circulating chamber. If one were to define the space between the free end 124 of the capillary break and the opposing wall (i.e., lower surface 110) of the recess as having a first vertical cross-sectional area and the space between the opposing walls of the circulating chamber (i.e., the distance "$H_V$" as having a second vertical cross-sectional area, the second vertical cross sectional area is preferably at least about 125% of the first vertical cross sectional area and more preferably at least about 150%. of the first vertical cross sectional area.

The rear surface 120 of the capillary break 74 has a concave or curved shape to facilitate the formation of the vortex 106.

The relative dimensions of the capillary break 74 are important to its performance. Preferably, the height "$H_C$" of the capillary break is at least about 100% and more preferably ranges from about 125 to about 200% of the distance "$D_C$" between the free end 124 of the capillary break 74 and the opposing surface 110 of the recess 90.

The locations of the drainage holes 78 relative to the capillary break is another important factor to performance. is The drainage holes 78 are preferably located on the same side of the recess 82 as the capillary break 74 (i.e , in the upper portion of the recess 82) such that the wind does not have a straight line path from the inlet 90 to a drainage hole 78. For a substantially horizontally oriented drainage hole 78, the distance "$D_H$" from the rear surface 120 of the capillary break 74 to the edge 128 of the drainage hole 78 must be to place the drainage hole outside of the vortex and more preferably is at least about 0.25 inches.

Figure 4:
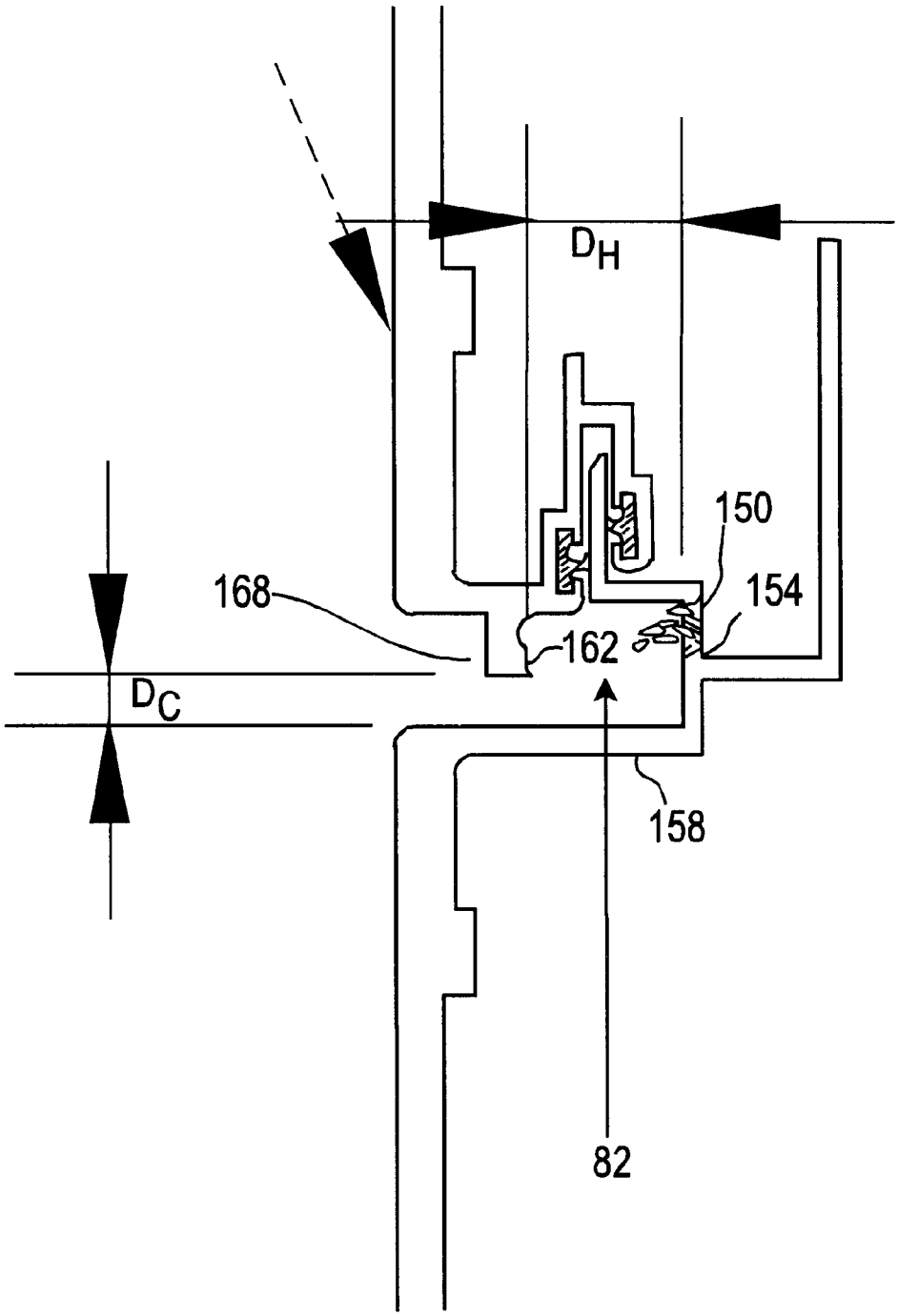
FIG. 4 is a second embodiment of a wall panel mounting system according to the first aspect of the present invention.

FIG. 4 depicts a second embodiment of a wall panel mounting assembly according to the first aspect of the present invention. In the second embodiment, the drainage holes 150 are located on a substantially vertical surface 154 of the lower perimeter framing member 158. Because a vertically oriented drainage hole is more susceptible to the entry of fluids than the horizontally oriented drainage hole of FIG. 2, the preferred minimum distance "$D_H$" from the rear surface 162 of the capillary break 168 for the second embodiment is greater than the preferred minimum distance "$D_H$" from the rear surface for the first embodiment. More preferably, the drainage hole 150 is located at least about 0.75 inches from the rear surface 162 of the capillary break. The center of the drainage hole 150 is located above the free end 124 of the capillary break 168 and more preferably the entire drainage hole 150 is located above the free end 124 of the capillary break 168.

Figure 5:
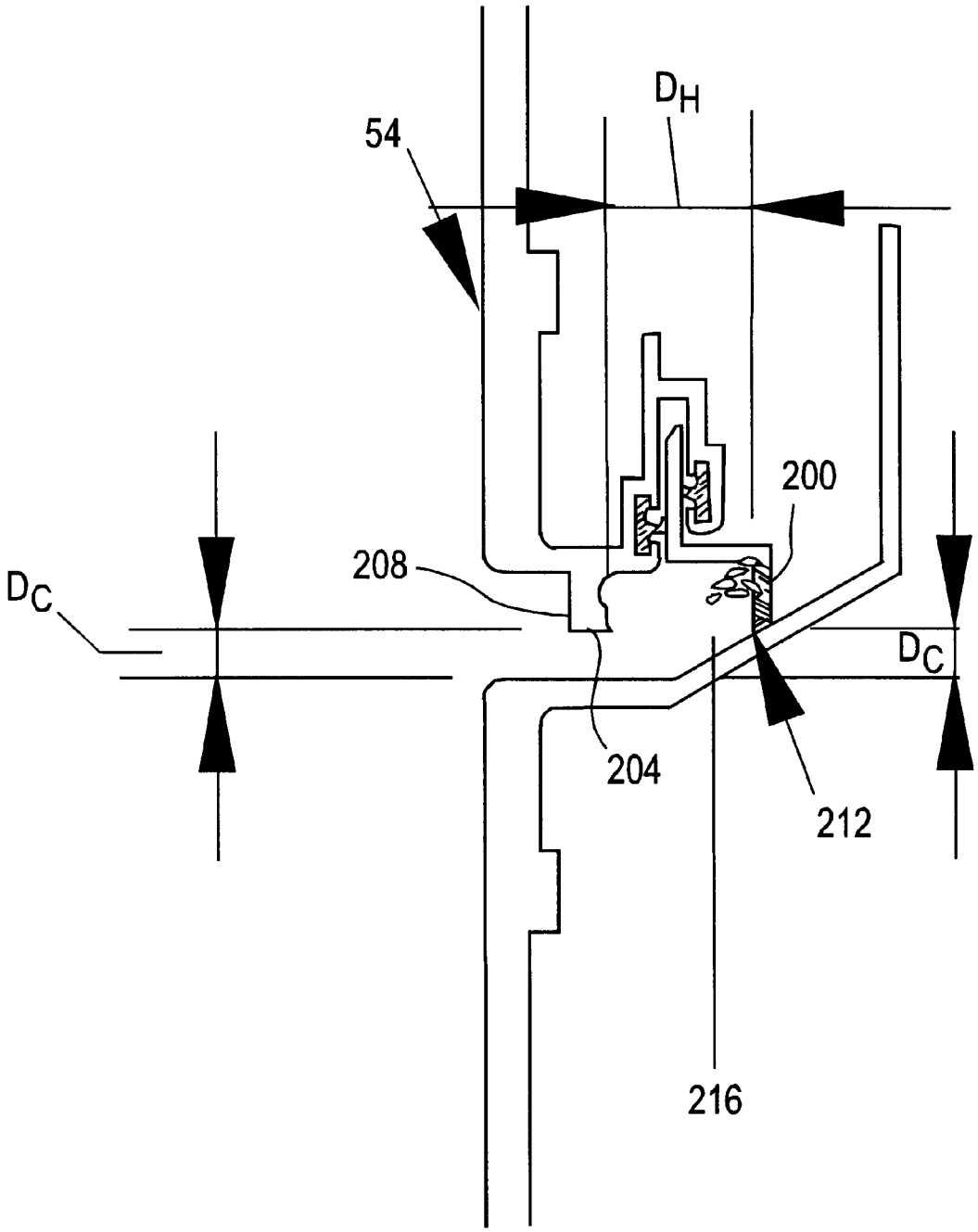
FIG. 5 is a third embodiment of a wall panel mounting system according to the first aspect of the present invention.

FIG. 5 depicts a third embodiment of a wall panel mounting assembly according to the first aspect of the present invention. In the third embodiment, the drainage holes 200 are located above the free end 204 of the capillary break 208 with an inclined surface 212 extending from the drainage holes 200 to a point below the capillary break 208. The inclined surface 212 facilitates removal of fluids from the recess 216 and thereby inhibits build-up of fluids in a corner of the recess 216.

FIG. 6A depicts a third embodiment of a wall panel attachment system according to a second aspect of the present invention. The system uses a flexible sheet interlock to seal adjacent perimeter framing members. At the joint between the upper perimeter framing members 66*a,b* of adjacent wall panels 54*a,b*, a flexible sheet interlock 250 inhibits fluid migration along the joint defined by the adjacent ends 254*a,b* of the adjacent gutters of the perimeter framing members 66*a,b*. The flexible sheet interlock 250 realizes this result by retaining fluids in the adjacent gutters 83*a,b*. Accordingly, the interface between the flexible sheet interlock 250 and the gutter walls is substantially impervious to fluid migration. As can be seen from FIG. 6B, the flexible sheet interlock has sufficient flexibility to conform to the "U"-shaped contour of the gutter.

Figure 7:
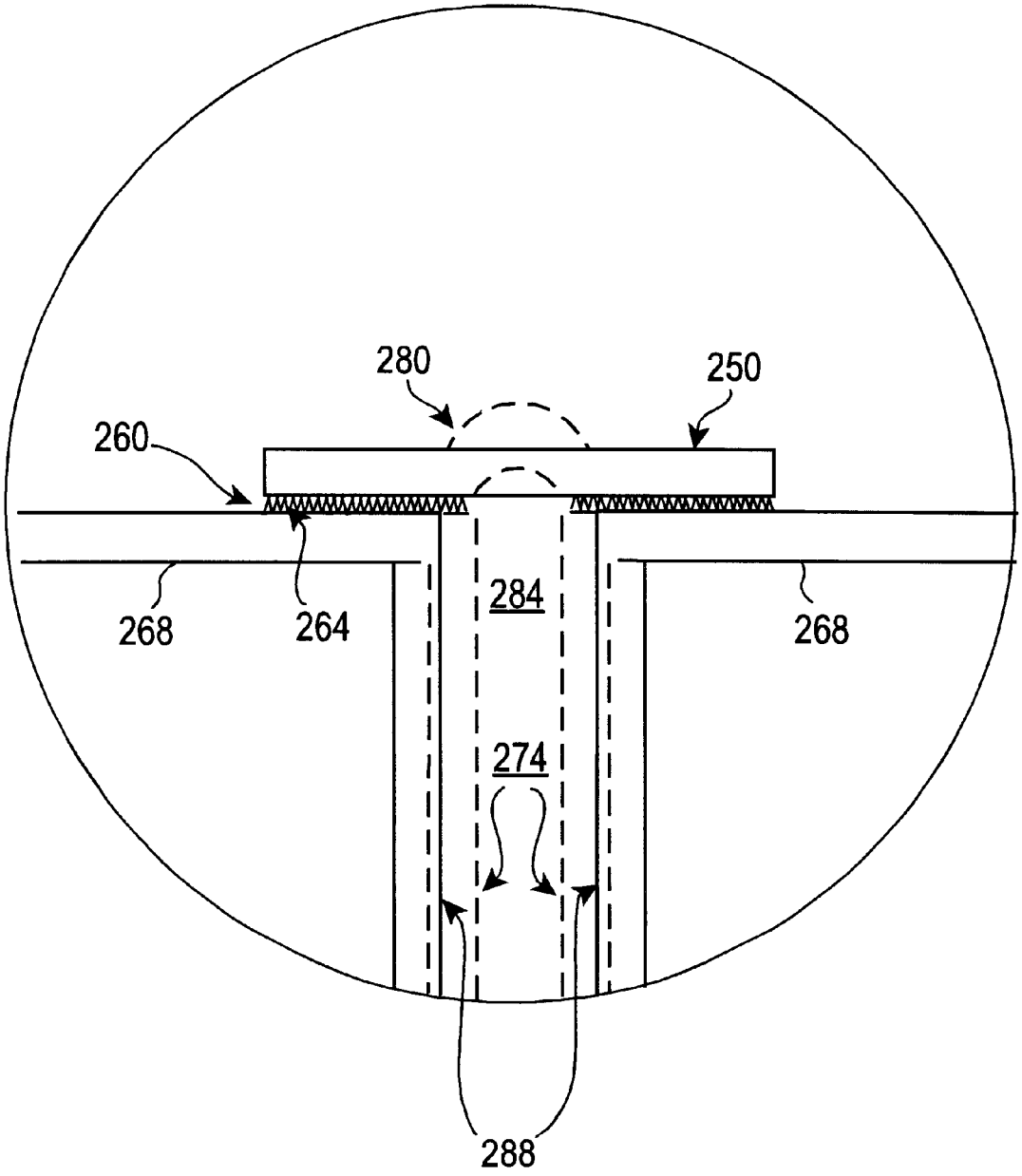
FIG. 7 depicts the behavior of the flexible sheet interlock in response to thermal contractions in the wall panels.

Referring to FIGS. 6A and 7, the interface 260 can include an adhesive 264 between the flexible sheet interlock 250 and each of the three gutter walls 268*a,b,c* to retain the interlock 250 in position. Although the flexible sheet interlock 250 itself may possess adhesive properties, an adhesive, preferably having sealing properties, has been found to assist the formation and maintenance of an integral seal between the interlock 250 and the gutter walls 268. The most preferred adhesive is a high performance compressed joint sealant that can "set up" or harden and bond to the gutter wall and the interlock. Examples of such sealants include silicone, urethane, and epoxy. Because the interlock 250 itself absorbs all of the thermal movement of the wall panels, there is no requirement for the adhesive 264 to stay resilient and move. The end result is a more economical system for sealing adjacent perimeter framing members that has a useful life equal to that of the exterior wall panel system.

As can be seen from FIG. 7, when the perimeter framing members are expanded due to thermal or building movements (the perimeter framing member positions denoted by arrows 274), the portion 280 of the interlock 250 in the gap 284 between the adjoining perimeter framing members deforms and thereby absorbs the movement without a failure of the seal. When the perimeter framing members are in a relaxed state (the perimeter framing member positions denoted by arrows 288), the interlock 250 returns to its normal position.

Figure 8:
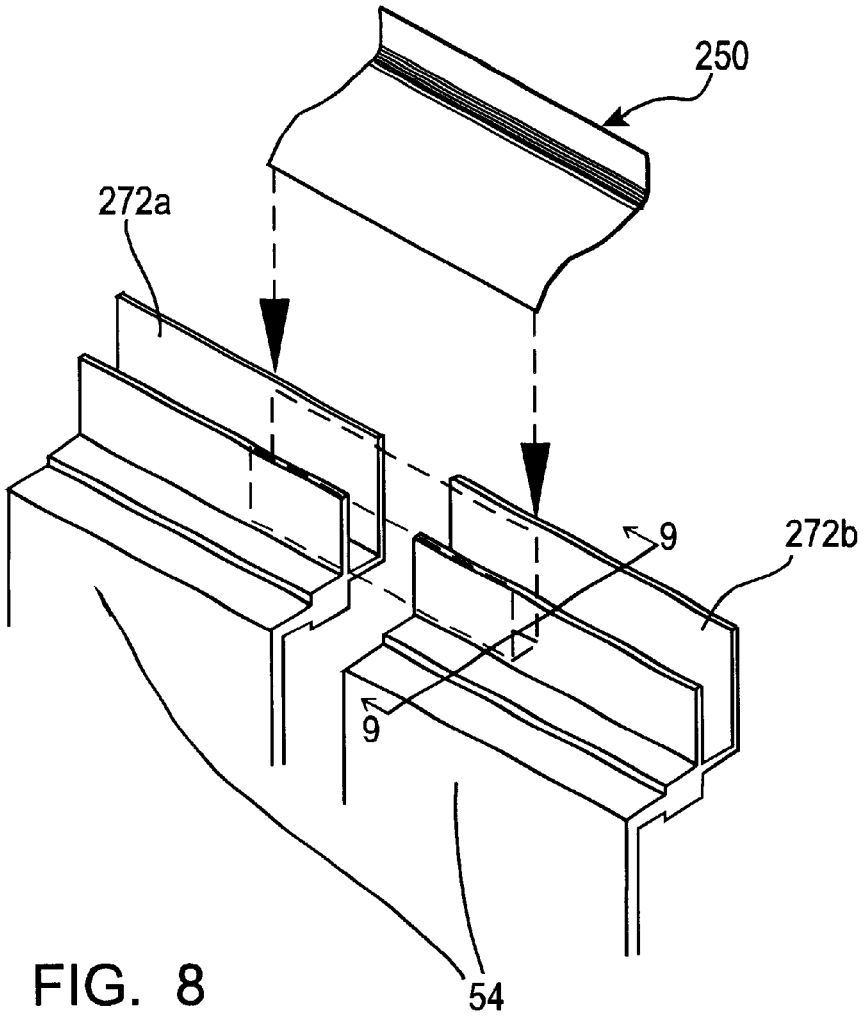
FIG. 8 depicts a first method for installing the flexible sheet interlock to seal a joint between adjacent perimeter framing members.
Figure 9:
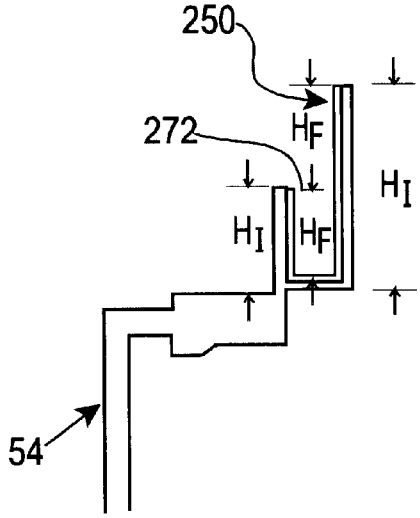
FIG. 9 is a sectional view along line 9—9 of FIG. 8.

Referring to FIGS. 8 and 9, the dimensions of the flexible interlock 250 are sufficient to prevent fluids from spilling over the sides of the interlock 250 before the fluid depth in the gutter 272 reaches the depth of the gutter. After installation in the gutter 272, the heights "$H_F$" of the sides 268*a,b* of the interlock 250 are substantially the same as the heights "$H_I$" of the corresponding (i.e., adjacent) side walls 268*a,c* of the gutter.

FIGS. 8–9 depict a method for installating the interlock 250 across the adjacent ends of the gutters 272*a,b*. The interlock 250 is pressed down in the gutters 272 until the interlock 250 substantially conforms to the shape of the gutter as depicted in FIG. 9.

Figure 10:
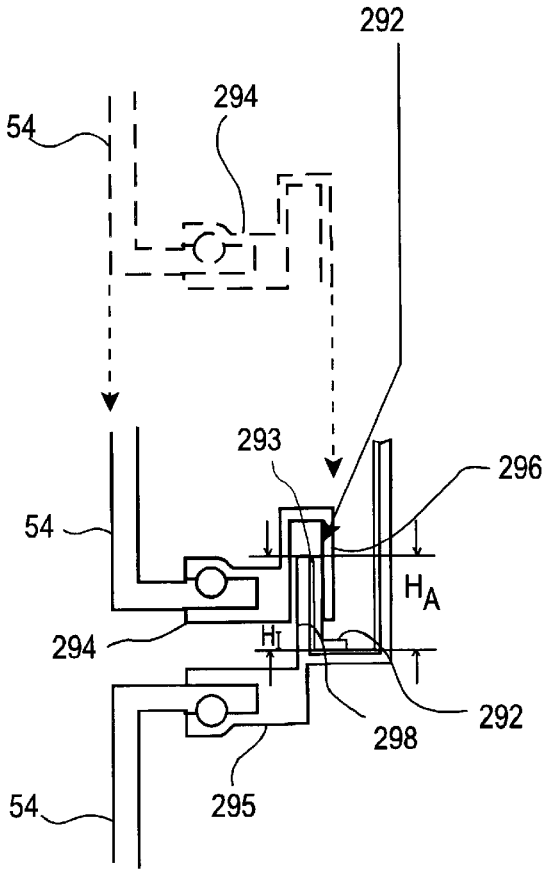
FIGS. 10–11 depict a second method for installing the flexible sheet interlock which uses a rigid insert to protect the edges of the flexible sheet interlock.
Figure 11:
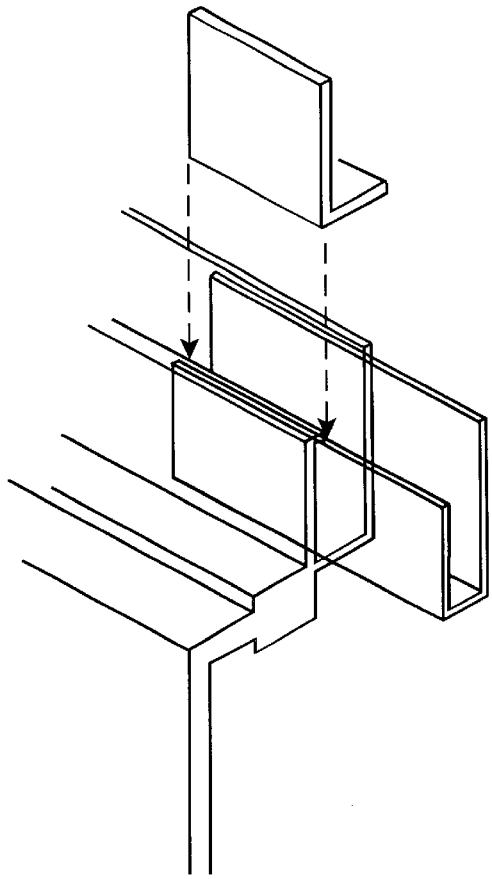
Figure 12:
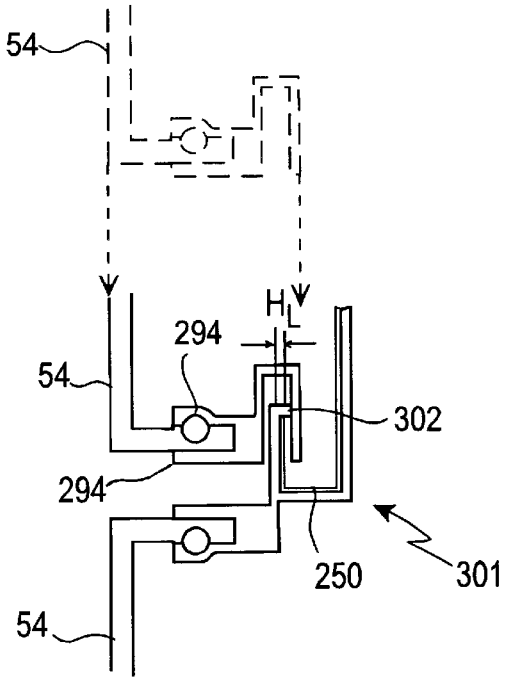
FIGS. 12–13 depicts a third method for installing the flexible sheet interlock which uses a shelf or lip on the perimeter framing member to protect the edges of the flexible sheet interlock.
Figure 13:
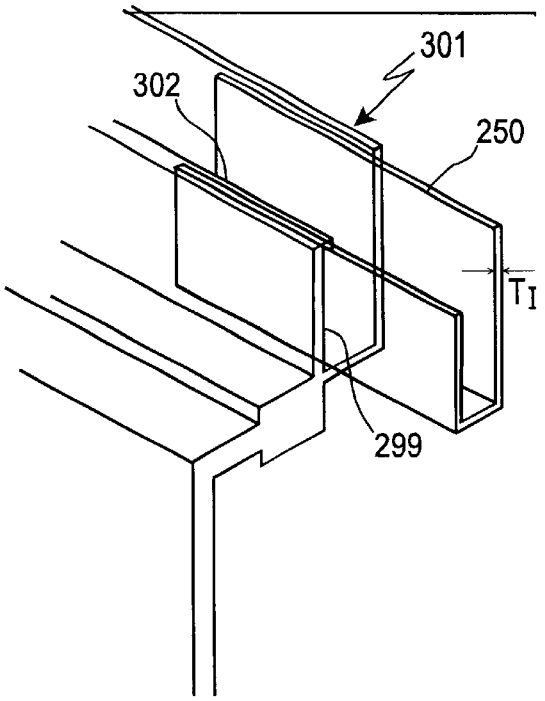

In FIGS. 10–13, alternative methods are depicted for installing the flexible sheet interlock 250 in the gutters. In second method shown in FIGS. 10–11, a substantially rigid insert 292 can be employed to protect the exposed edge 293*a,b* of the interlock 250 during the lower perimeter framing member 294 of an adjoining wall panel 54 with the upper perimeter framing member 295. As will be appreciated, in the absence of the insert the inner surface 296 of the lower perimeter framing member 294 can "roll up" the interlock 250 due to frictional forces during engagement of the upper and lower perimeter framing members 294 and 295 with one another. The "L"-shaped insert 292, which can be any substantially rigid material such as metal or plastic, is received between the upper and lower perimeter framing members and inhibits the rolling up of the interlock when the perimeter framing members are placed into an interlocking relationship. The insert 292 and interlock 250 are positioned in a nested relationship as shown in FIG. 10. To operate effectively, the height "$H_A$" of the engaging surface 297 of the insert 292 has substantially the same length as the height "$H_I$" of the corresponding (i.e., adjacent) gutter wall 298. As will be appreciated, the insert 292 is not required to be an "L"-shape but can be any other shape that matches the inner contour of the gutter such as a "U"-shape. In a third method for installing the flexible sheet interlock 250 shown in FIGS. 12–13, the inner surface 299 of the gutter 301 includes a lip 302 extending inwardly to protect the edges of the interlock during installation of the upper perimeter framing member 294. The height of the lip "$H_L$" is preferably at least the same as the thickness "$T_I$" of the interlock 250.

Figure 14:
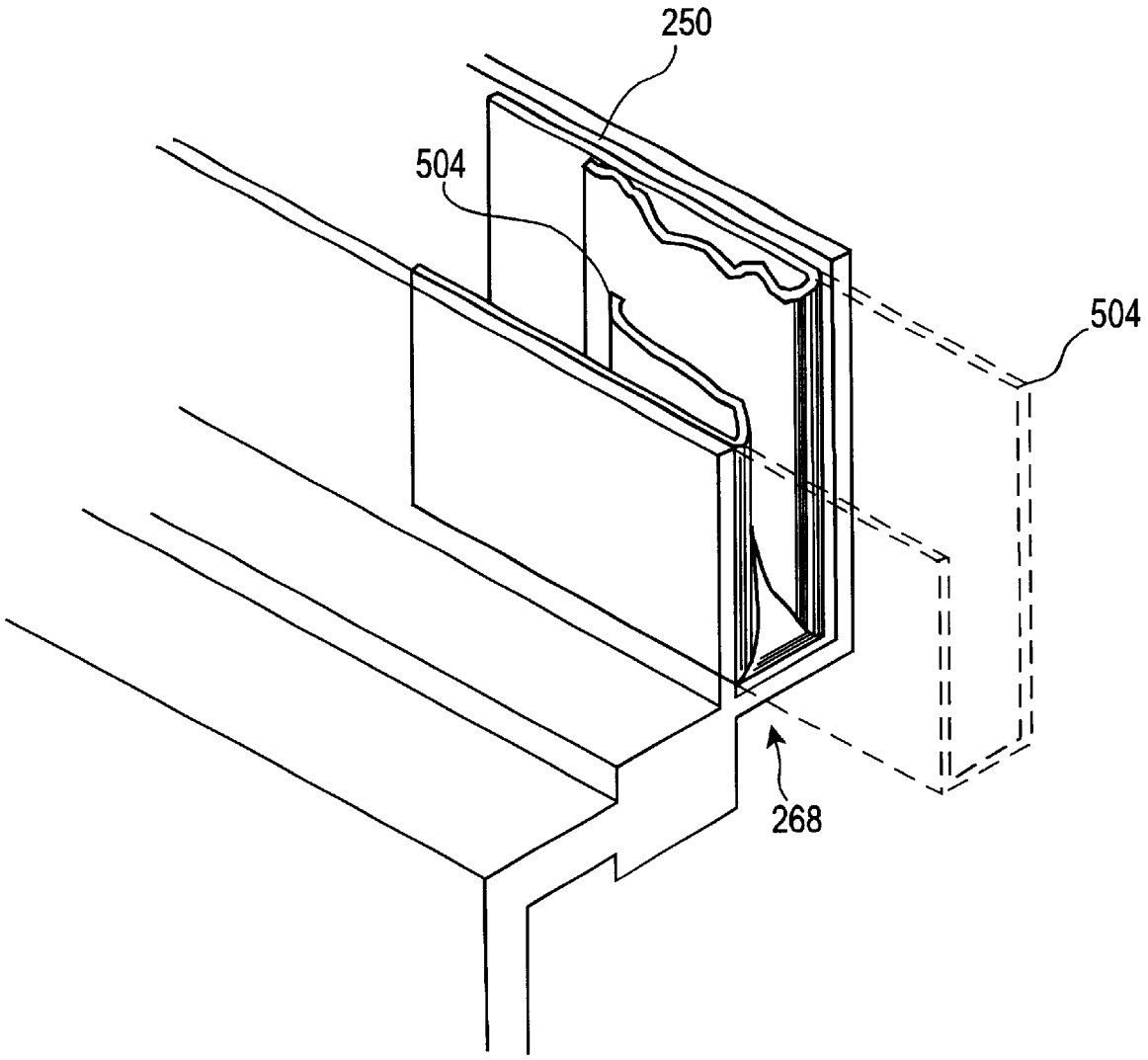
FIG. 14 depicts the exposed edges of the flexible sheet interlock being folded back onto itself during installation of an adjacent wall panel.
Figure 15:
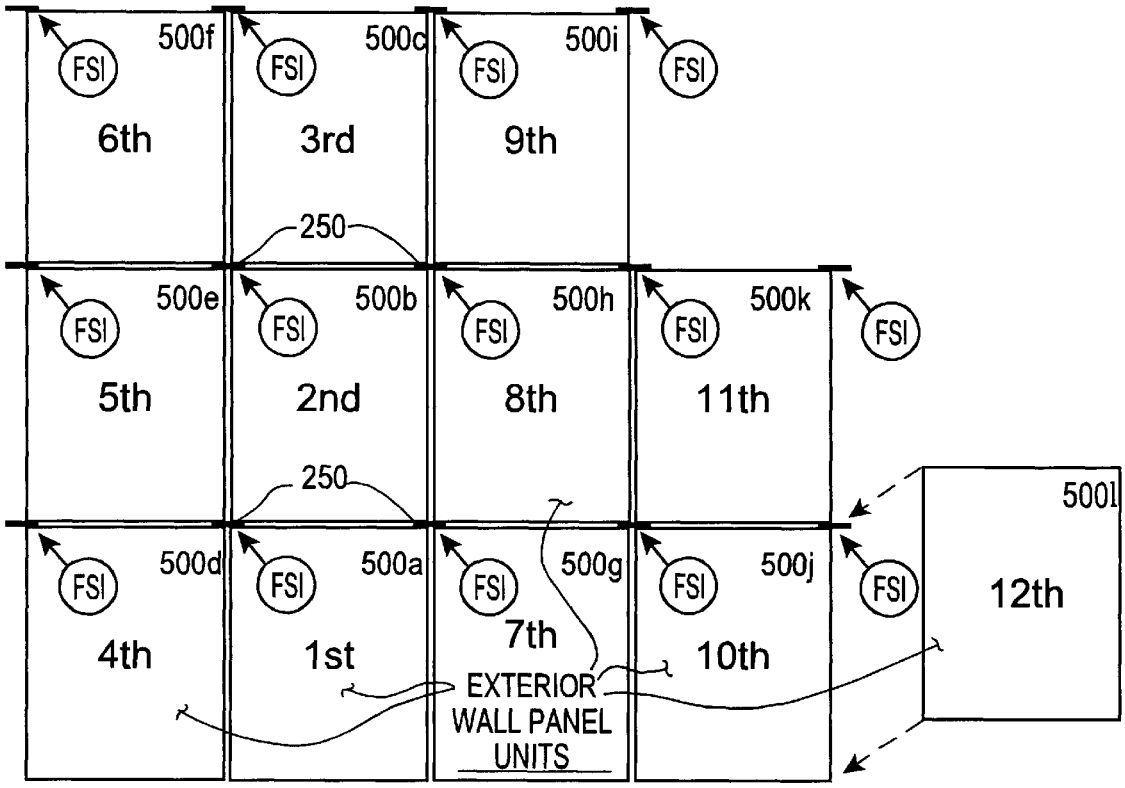
FIG. 15 depicts a preferred sequence for installing wall panels using the flexible sheet interlock.
Figure 16:
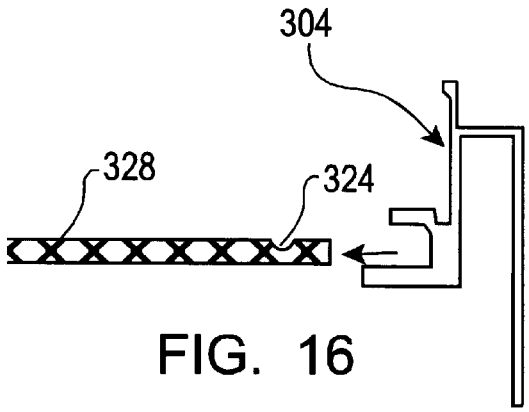
FIGS. 16–22 depict a fourth embodiment of a wall panel mounting system according to a third aspect of the present invention.

FIGS. 14 and 15 depict a preferred method for installing wall panel systems using the flexible sheet interlock 250. The numbers on the wall panels (e.g., 1st, 2nd, 3rd, etc.) denote the order in which the wall panels are attached to the wall support members. Although the conventional "stair step" method can also be employed with the interlock, the method of FIG. 15 is simpler, less expensive, and has more flexibility in installation.

The installation method will now be explained with reference to FIGS. 8–9 and 14–15. In a first step, the wall panel system 500*a* is attached to the wall support members. In a second step, the adhesive 264 is applied to either or both of a flexible sheet interlock 250 and adjoining gutter surfaces 268*a–c* and the flexible sheet interlock 250 is engaged with each end 254*a,b* of the wall panel system 500*a*. In a third step, the wall panel systems 500*b,c* are attached to the wall support members, and flexible sheet interlocks 250 are attached with the ends of the systems as described above. In a fourth step, the protruding end 504 of the interlock 250 is folded away from the edge of the wall panel system 500*a* as shown in FIG. 14 and the wall panel system 500*d* is attached to the wall support members. A flexible sheet interlock 250 is then attached to the end of the wall panel system 500*d*, The above steps are repeated to install the remaining wall panel systems 500*e–l*.

Referring to FIGS. 16–21, a fourth embodiment according to a third aspect of the present invention is illustrated. The third aspect of the invention is used to attach the wall panels to the perimeter framing members. The wall panel assembly 300 includes a perimeter framing member 304, a wedge-shaped member 306, and an attachment member 308 (which is preferably a rigid or semi-rigid material such as metal). The attachment member 308 has an L-shaped member 312 that engages a grooved member 316 in the perimeter framing member 304. The attachment member 308 has a cylindrically-shaped bearing surface 320 that is received in a groove 324 in the panel member 328 substantially along the length of the side of the panel member 328. One end 336 of the wedge-shaped member 306 engages a step 332 in the perimeter framing member 304 and the other end 340 of the wedge-shaped member 306 engages a step 344 in the attachment member 308. The wedge-shaped member 306 is suitably sized to cause the bearing surface 320 of the attachment member 308 to be forced against the groove in the panel member, thereby holding the panel member assembly 300 in position. The bearing surface 320 can have any number of desired shapes, including v-shaped, star-shaped, and the like.

Figure 17:
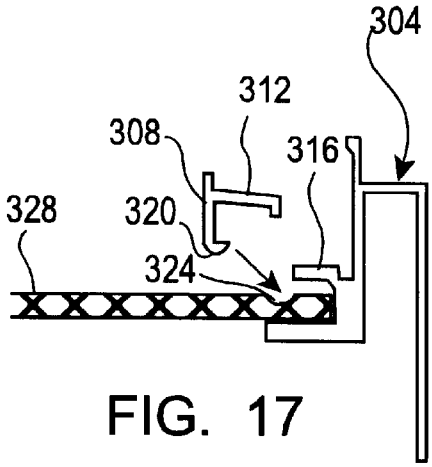
Figure 18:
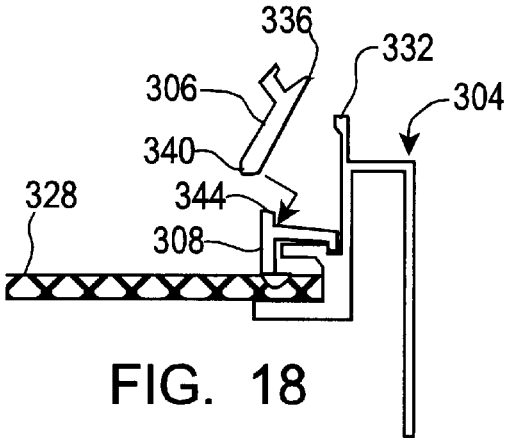
Figure 19:
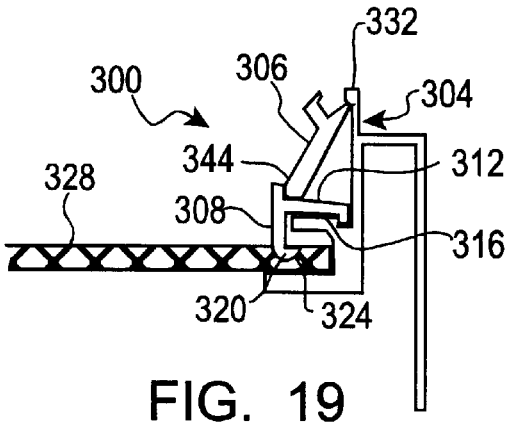
Figure 20:
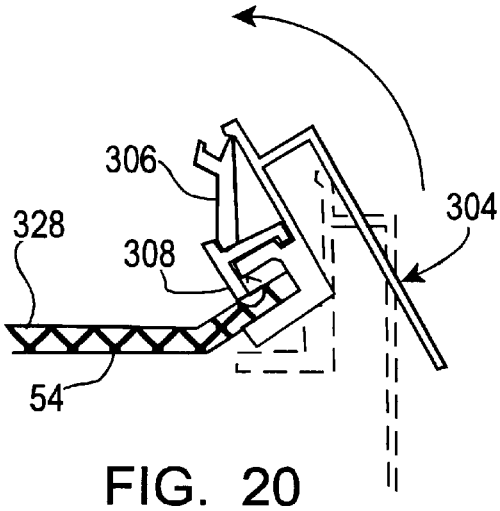
Figure 21:
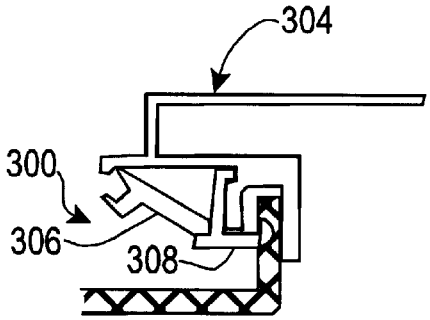

The steps to assemble the panel member assembly 300 are illustrated in FIGS. 16–21. In the first step illustrated by FIG. 16, the panel member 328 is positioned in the pocket 350 of the perimeter framing member 304. In FIG. 17, the L-shaped member 312 is engaged with the grooved member 316 of the perimeter framing member 304, and the bearing surface 320 is engaged with the groove in the panel member. In FIGS. 18–19, the lower end of the wedge-shaped member 306 is engaged with the step 344 of the attachment member, and the upper end of the wedge-shaped member 306 is then forcibly engaged with the step 332 in the perimeter framing member. In FIGS. 20–21, the edge of the panel member is bent at a 90 degree angle about a predetermined line in the panel member. Interlocking flanges of adjacent perimeter framing members can then be engaged to form the building surface.

FIGS. 22–28 depict a fifth embodiment according to the third aspect of the present invention. The wedge-shaped member 306 of the previous embodiment is replaced with a screw 404 or other fastener to hold the perimeter framing member 304 and attachment member 308 in position on the panel member 328. The fastener passes through the attachment member and perimeter framing member.

Figure 22:
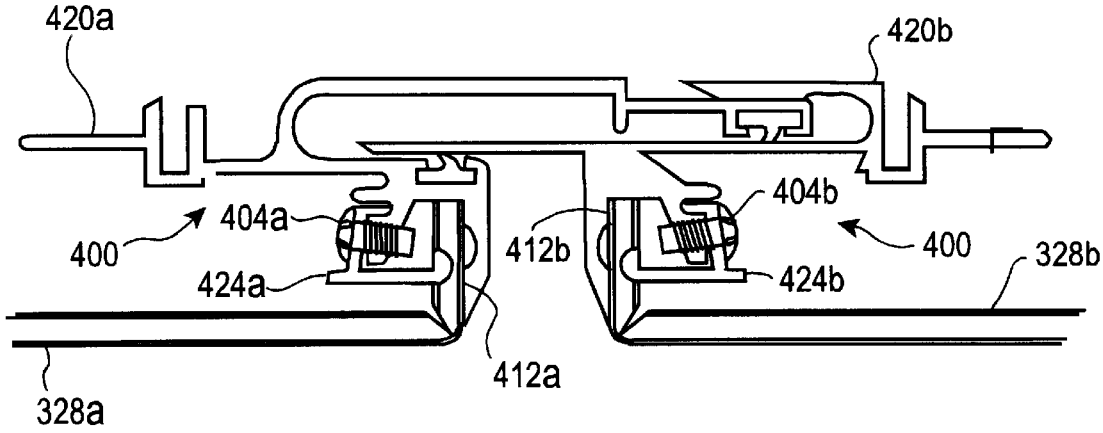
Figure 23:
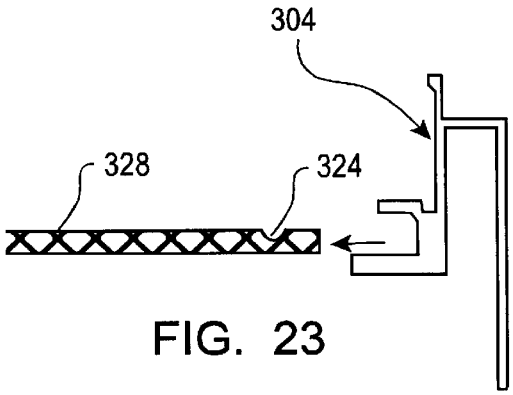
FIGS. 23–28 depict a fifth embodiment of a wall panel mounting system according to the third aspect of the present invention.
Figure 24:
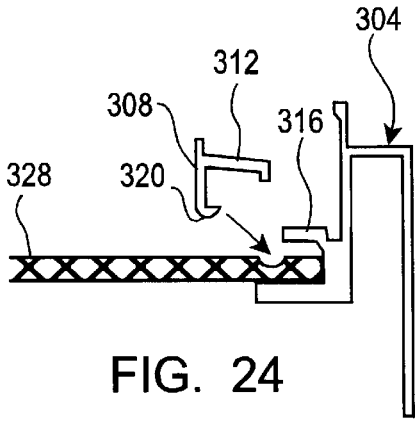
Figure 25:
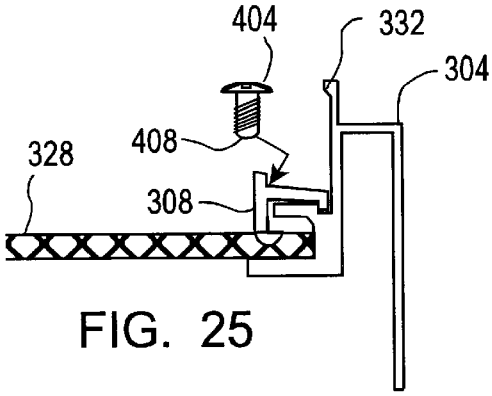
Figure 26:
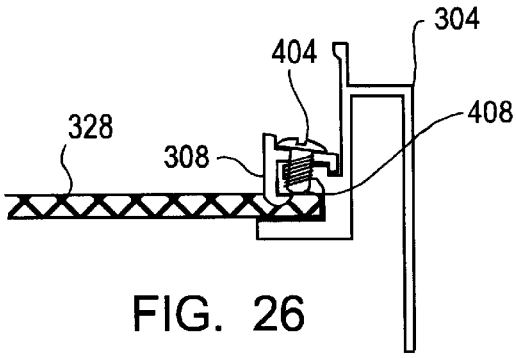
Figure 27:
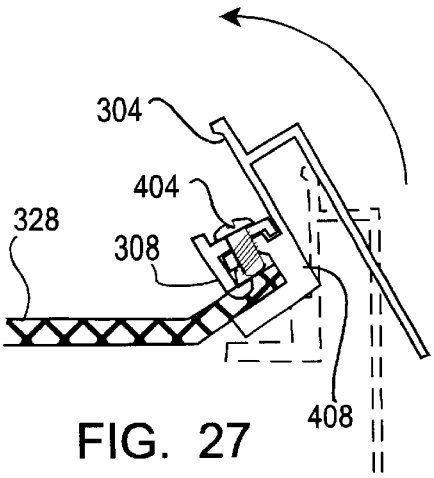
Figure 28:
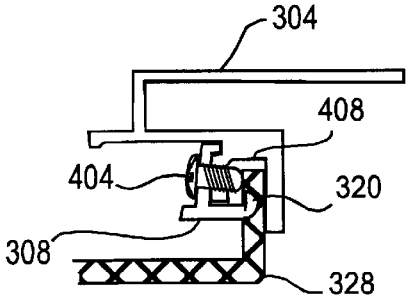

The steps to assemble the panel member assembly 400 are illustrated by FIGS. 23–28, with FIG. 23 illustrating the first step, FIG. 24 the second step, FIGS. 25–26 the third step, and FIGS. 27–28 the last step. FIG. 22 depicts another configuration of this embodiment using differently configured perimeter framing members 420*a,b* and attachment members 424*a,b*. The perimeter framing members 420*a,b* are in the interlocked position for mounting the panels on a support surface.

While various embodiments have been described in detail, it is apparent that modifications and adaptations of those embodiments will occur to those skilled in the art. However, it is to be expressly understood that such modifications and adaptations are within the scope of these inventions, as set forth in the following claims.

What is claimed is:

1. A wall system, comprising:

(a) a panel having a groove in a first surface of the panel;

(b) a perimeter framing member for engaging a peripheral edge of the panel, the perimeter framing member having two opposing surfaces forming a pocket for receiving the panel; and (c) an attachment member having a first bearing surface to be received in the groove in the first surface of the panel and a second bearing surface engaging a surface of the perimeter framing member to align and hold the panel in the pocket, wherein at least a portion of the attachment member is to be positioned between an opposing surface of the pocket and a surface of the panel wherein the second bearing surface engages a surface of the perimeter framing member located outside of the pocket, when the panel is engaged with the attachment member.

2. The wall system of claim 1, wherein the other opposing surface of the pocket contacts a second surface of the panel when the panel is engaged with the attachment member.

3. The wall system of claim 2, wherein the second bearing surface is received in a groove in the opposing surface of the pocket when the panel is engaged with the attachment member.

4. The wall system of claim 1, wherein the attachment member is "L" shaped.

5. The wall system of claim 1, further comprising a wedge member for engaging simultaneously a surface of the attachment member and a surface of the perimeter framing member to hold the attachment member in position against the panel when the panel is engaged with the attachment member.

6. The wall system of claim 1, further comprising a fastener to fasten the attachment member to the perimeter framing member.

7. The wall system of claim 1, wherein the attachment member is rod-shaped.

8. The wall system of claim 1, wherein the panel is folded such that the peripheral edge of the panel is offset from a face of the panel.

9. The wall system of claim 1, wherein the panel is at least one of wood, plastic, metal, ceramics, masonry, and composites thereof.

10. A wall system, comprising:

(a) a panel having a groove in a first surface of the panel;

(b) a perimeter framing member for engaging a peripheral edge of the panel, the perimeter framing member having two opposing surfaces forming a pocket for receiving the panel; and (c) an attachment member having a first bearing surface to be received in the groove in the first surface of the panel and a second bearing surface engaging a surface of the perimeter framing member, to align and hold the panel in the pocket, wherein the perimeter framing member surface is located outside the pocket; and (d) a retention member engaging a surface of the attachment member and a surface of the perimeter framing member retaining the attachment member in position when the attachment member is engaged with the panel.

11. The wall system of claim 10, wherein the two opposing surfaces are substantially parallel to one another and to the first surface of the panel, when the attachment member is engaged with the panel.

12. The wall system of claim 10, wherein the attachment member is in the shape of an "L".

13. The wall system of claim 12, wherein the retention member engages the attachment member at the base of the "L".

14. The wall system of claim 10, wherein the retention member functions in the same manner as a wedge.

15. The wall system of claim 10, wherein the first bearing surface is at least partially located in the pocket when the attachment member is engaged with the panel.

16. The wall system of claim 10, wherein, when the attachment member is engaged with the panel, the first surface of the panel is spaced from one of the opposing surfaces ofthe perimeter framing member and a second surface ofthe panel, which is in an opposing relationship with the first surface, engages the other opposing surface of the perimeter framing member.

17. The wall system of claim 10, wherein the retention member is a fastener.

18. The wall system of claim 10, wherein the attachment member is rod-shaped.

19. The wall system of claim 10, wherein the panel is folded such that the peripheral edge of the panel is offset from a face of the panel.

20. The wall system of claim 10, wherein the panel is at least one of wood, plastic, metal, ceramics, masonry, and composites thereof.

21. A wall system, comprising:

(a) a panel having first and second surfaces and a groove in the first surface of the panel;

(b) at least one perimeter framing member engaging the panel, the at least one perimeter framing member having two opposing first and second surfaces forming a pocket receiving the panel; and (c) an attachment member, the attachment member being received in the groove to align and hold the panel in the pocket, the attachment member having a second bearing surface;

wherein the second bearing surface engages a surface of the at least one perimeter framing member located outside of the pocket, when the panel is engaged with the attachment member.

22. The wall system of claim 20, wherein at least a portion of the attachment member is positioned between at least one of the opposing first and second surfaces of the pocket and at least one of the first and second surfaces of the panel.

23. The wall system of claim 22, wherein the other of the opposing first and second surfaces of the pocket contacts a second surface of the panel when the panel is engaged with the attachment member.

24. The wall system of claim 23, wherein the second bearing surface is received in a groove on a surface outside of the pocket when the panel is engaged with the attachment member.

25. The wall system of claim 21, wherein the attachment member is "L" shaped.

26. The wall system of claim 21, further comprising a wedge member engaging simultaneously a surface of the attachment member and a surface of the at least one perimeter framing member to hold the attachment member in position against the panel when the panel is engaged with the attachment member.

27. The wall system of claim 21, further comprising a fastener to fasten the attachment member to the at least one perimeter framing member.

28. The wall system of claim 21, wherein the attachment member is rod-shaped.

29. The wall system of claim 27, wherein the panel is folded such that the portion of the panel positioned in the pocket is transverse to a face of the panel.

30. The wall system of claim 21, wherein the panel is at least one of wood, plastic, metal, ceramics, masonry, and composites thereof.

* * * * *